US007324655B2

(12) United States Patent
Sato

(10) Patent No.: US 7,324,655 B2
(45) Date of Patent: Jan. 29, 2008

(54) ELECTROACOUSTIC TRANSDUCER

(75) Inventor: Mamoru Sato, Sendai (JP)

(73) Assignee: NEC TOKIN Corporation, Sendai-shi (JP)

( * ) Notice: Subject to any disclaimer, the term of this patent is extended or adjusted under 35 U.S.C. 154(b) by 340 days.

(21) Appl. No.: 10/520,098

(22) PCT Filed: Jul. 4, 2003

(86) PCT No.: PCT/JP03/08526

§ 371 (c)(1),
(2), (4) Date: Jan. 3, 2005

(87) PCT Pub. No.: WO2004/006620

PCT Pub. Date: Jan. 15, 2004

(65) Prior Publication Data

US 2006/0165249 A1 Jul. 27, 2006

(30) Foreign Application Priority Data

Jul. 4, 2002 (JP) ..... 2002-195714

(51) Int. Cl.
*H04R 25/00* (2006.01)

(52) U.S. Cl. ..... 381/370; 381/151; 381/396; 381/410

(58) Field of Classification Search ..... 381/396, 381/398, 412, 419, 420, 151, 403–404, 409, 381/410, 370; 310/81; 335/222; 340/388.1, 340/388.3, 388.4, 391.1
See application file for complete search history.

(56) References Cited

U.S. PATENT DOCUMENTS 5,861,686 A * 1/1999 Lee ..... 310/36
6,208,237 B1 * 3/2001 Saiki et al. ..... 340/388.1
6,570,993 B1 * 5/2003 Fukuyama ..... 381/396
6,847,139 B2 * 1/2005 Ueda et al. ..... 310/81
6,850,138 B1 2/2005 Sakai
2001/0030474 A1 10/2001 Sakai et al.
2001/0033215 A1 10/2001 Sakai
2002/0064293 A1 5/2002 Kobayashi et al.

FOREIGN PATENT DOCUMENTS

EP 0 845 920 A2 6/1998
EP 1 145 770 A2 10/2001
EP 1 211 911 A2 6/2002
JP 60-22895 A 2/1985
JP 60-84096 A 5/1985

(Continued)

*Primary Examiner*—Huyen Le
(74) *Attorney, Agent, or Firm*—Frishauf, Holtz, Goodman & Chick, P.C.

(57) ABSTRACT

A small earphone or headphone which can produce a wide band acoustic output from a low-pitched tone to a high-pitched tone and can generate a body-sensitive vibration independent output or a body-sensitive vibration output synchronized with a music. The earphone or headphone is mounting a vibration actuator which is provided with a magnetic circuit including a permanent magnet, a yoke, and a plate for concentrating the flux of the permanent magnet, with a coil disposed in an air gap of the magnetic circuit, with a diaphragm fixed with the coil and being imparted with a driving force therefrom, and with a vibration transmitting section for supporting the magnetic circuit flexibly through a suspension comprising a flexible spring.

12 Claims, 9 Drawing Sheets

FOREIGN PATENT DOCUMENTS

| | | | |
|---|---|---|---|
| JP | 6-269074 | A | 9/1994 |
| JP | 7-288887 | A | 10/1995 |
| JP | 11-355897 | A | 12/1999 |
| JP | 2000-244991 | A | 9/2000 |
| JP | 2000-244994 | A | 9/2000 |
| JP | 2000-334377 | A | 12/2000 |
| JP | 2001-16686 | A | 1/2001 |
| JP | 2001-300423 | A | 10/2001 |
| WO | WO 01/41496 | A2 | 6/2001 |

* cited by examiner

ELECTROACOUSTIC TRANSDUCER

This application is a U.S. National Phase Application under 35 USC 371 of International Application PCT/JP2003/008526 filed Jul. 4, 2003.

TECHNICAL FIELD

The present invention relates to an earphone or headphone that is small in size and can produce a body sensible vibration such as a tactile sound, a vibration sound, or a conduction sound (hereinafter a body sensible vibration) and a wideband sound.

BACKGROUND ART

FIGS. 4 and 5 are partly-broken side views of a conventional typical earphone and a conventional typical headphone, respectively. As shown in FIG. 4 or 5, the conventional earphone or the conventional headphone of the type incorporates a small-sized speaker 21 with an outside dimension of 13 mm or 30 mm and a height of 2 to 7 mm and thereby has a function of producing a sound. There has also been such an earphone or headphone commercially available that incorporates, separately from the speaker 21, a vibrating member 4 serving as a vibration generation source as shown in FIG. 6 or 7 in order to further achieve a body sensible vibration function. However, an outside dimension thereof is 25 mm or more.

In order to generate a sound and a body sensible vibration, the conventional earphone or headphone of the type must be mounted with the respective individual components therefor. Consequently, there have been problems of an increase in cost of the components, an increase in mounting space, complexity of a control circuit, an increase in assembling cost, and so forth. Further, there has been a problem that, since the sound generating component such as the speaker is small in size and diameter, an output of low-pitched tone is small and therefore a wideband acoustic output cannot be produced.

It is therefore an object of the present invention to provide an earphone or headphone that is small in size and can produce an output of body sensible vibration and a wideband acoustic output from a low-pitched tone to a high-pitched tone, thereby solving the above-mentioned problems.

DISCLOSURE OF THE INVENTION

According to the present invention, there is obtained an earphone or headphone having a vibration actuator mounted as an electroacoustic transducer, the vibration actuator comprising a magnetic circuit including a permanent magnet, a yoke, and a plate used for concentrating magnetic flux of the permanent magnet, a coil disposed in an air gap of the magnetic circuit, a vibrating plate attached with the coil and imparted with a driving force by the coil, and a vibration transmitting portion flexibly supporting the magnetic circuit through a suspension formed by a flexible spring.

Further, according to the present invention, there is obtained the earphone or headphone, wherein, by simultaneously inputting a low frequency signal for generating a body sensible vibration and a signal for generating a sound and having a frequency higher than that of the low frequency signal, the vibration actuator simultaneously generates the body sensible vibration and the sound.

Further, according to the present invention, there is obtained the earphone or headphone, wherein, in the vibration actuator, the magnetic circuit vibrates in response to an input signal of a low-band frequency that generates a body sensible vibration and a low-pitched tone, both of the vibrating plate and the magnetic circuit vibrate in response to an input signal of an intermediate-band frequency, and the vibrating plate vibrates in response to an input signal of a high-band frequency to produce a high-pitched tone.

Thus, as a vibration actuator in which, by applying a wideband signal to a coil, the coil located in a magnetic circuit vibrates, or the magnetic circuit vibrates, or both the coil and the magnetic circuit vibrate, to thereby transmit the vibration to the exterior through a support, or the vibration of a vibrator is transmitted as an acoustic output produced by air vibration, the vibration actuator according to the present invention is characterized in that the body sensible vibration and the sound can simultaneously be produced. Accordingly, the present invention provides new media enabling information transmission including representation of emotions by the use of the sound and the body sensible vibration, that is not achieved in the art.

BEST MODE FOR CARRYING OUT THE INVENTION

Hereinbelow, an electroacoustic transducer according to embodiments of the present invention will be described with reference to the drawings.

Figure 1:
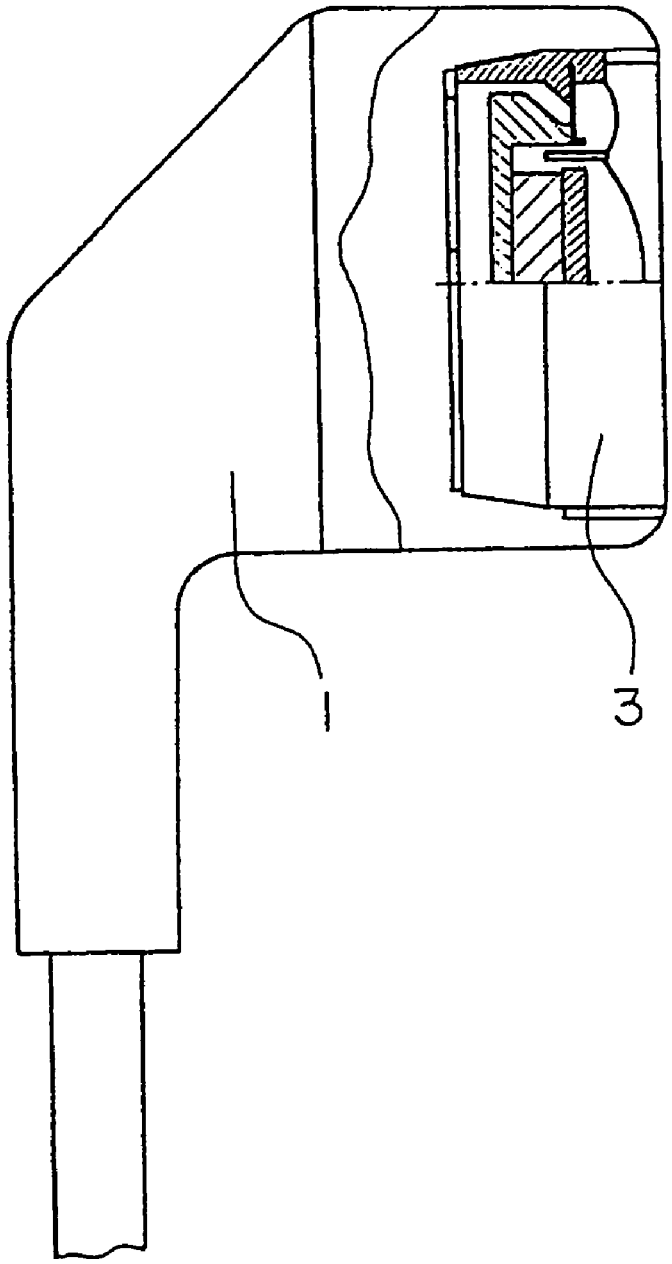
FIG. 1 is an external perspective view, partly sectioned, showing an earphone according to an embodiment of the present invention.
Figure 2:
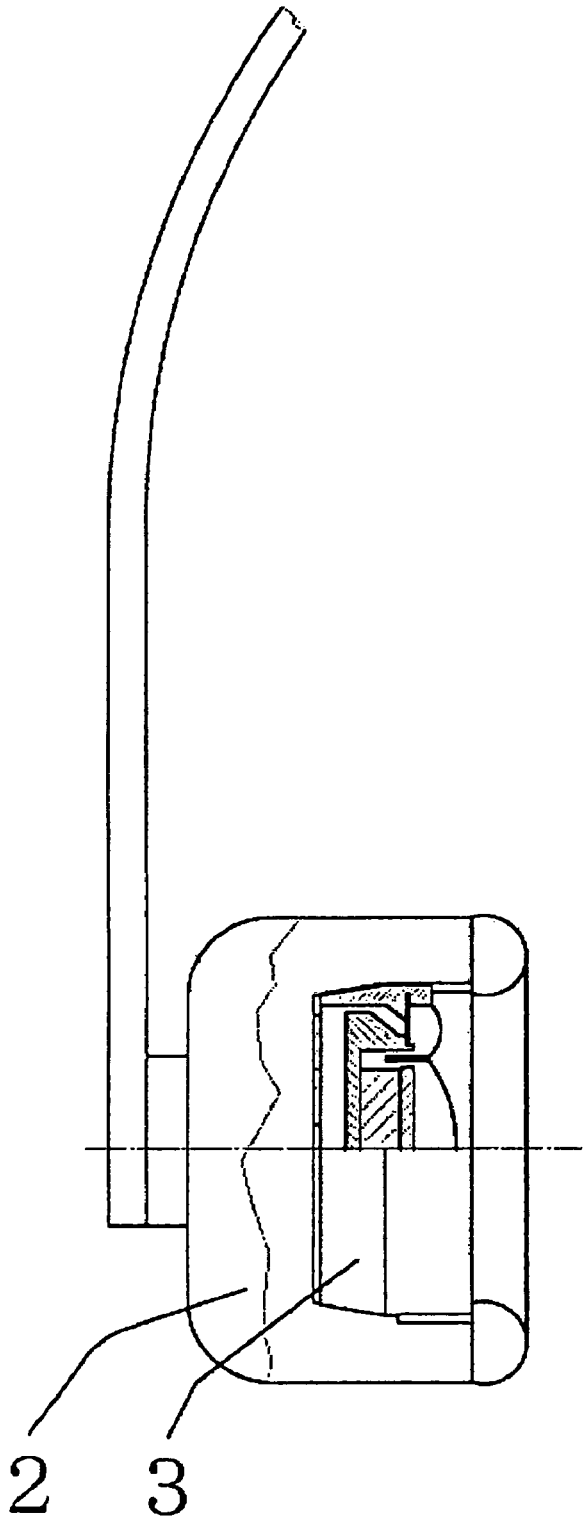
FIG. 2 is an external perspective view, partly sectioned, showing a headphone according to an embodiment of the present invention.

Referring to FIGS. 1 and 2, outside diameters of vibration actuators 3 mounted in an earphone and a headphone shown in these figures are 13 mm and 17 mm, respectively, and it is therefore possible to realize electroacoustic transducers each having an outside diameter not greater than 20 mm.

Figure 3:
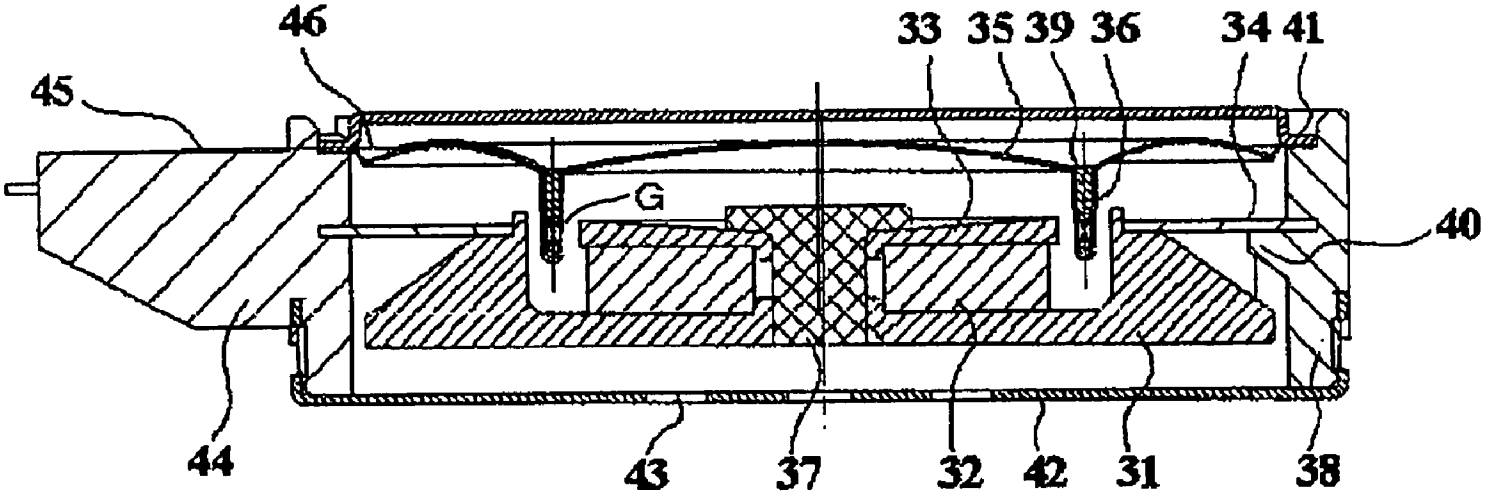
FIG. 3 is a sectional view of a vibration actuator mounted in each of the earphone and the headphone of FIGS. 1 and 2.
Figure 4:
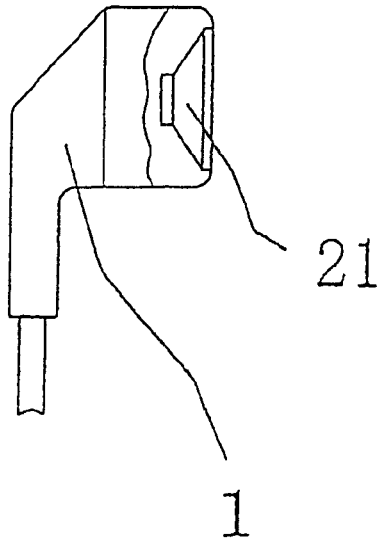
FIG. 4 PRIOR ART
FIG. 4 is an external perspective view, partly sectioned, showing a conventional earphone.
Figure 5:
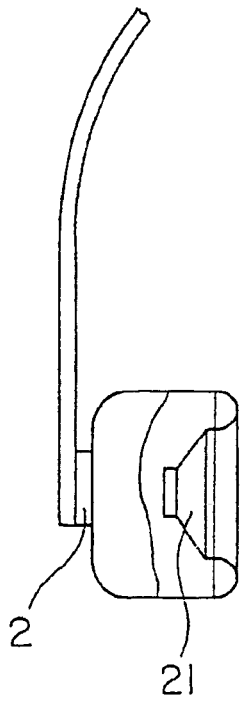
FIG. 5 PRIOR ART
FIG. 5 is an external perspective view, partly sectioned, showing a conventional headphone.
Figure 6:
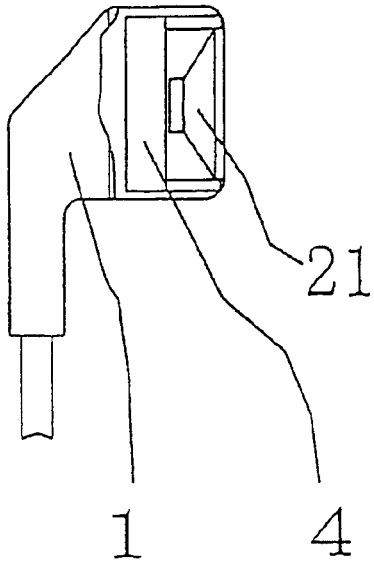
FIG. 6 PRIOR ART
FIG. 6 is an external perspective view, partly sectioned, showing a conventional earphone having a vibration generating function.
Figure 7:
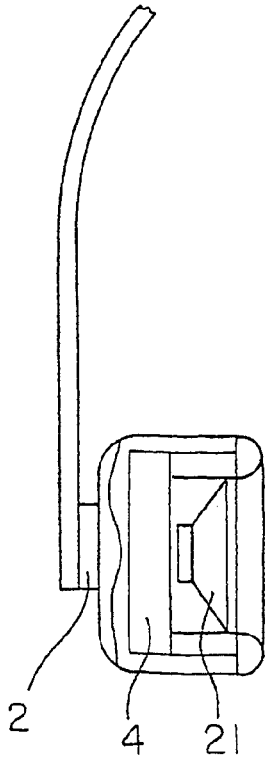
FIG. 7 PRIOR ART
FIG. 7 is an external perspective view, partly sectioned, showing a conventional headphone having a vibration generating function.

In the vibration actuator 3 used in FIG. 1 or 2, a magnetic circuit has an internal magnet structure in which a disc-shaped permanent magnet 32 is interposed between a yoke 31 and a plate 33, as shown in FIG. 3. A circular magnetic gap G is formed at a portion thereof. A center shaft 37 having a shape of a bolt, a pin, or the like is fitted into a center hole of the magnetic circuit to thereby position the yoke 31, the permanent magnet 32, and the plate 33 on the same axis. A suspension 34 comprises a single piece of an arc-shaped helical leaf spring and flexibly supports the magnetic circuit. Specifically, an inner end portion of the helical leaf spring is fixed to an outer peripheral portion of the yoke 31 by bonding using an elastic material, such as a pressure sensitive adhesive, an adhesive, or a resin, or by caulking or the like, while an outer end portion thereof is fixed to a vibration transmitting portion 38.

On the other hand, a coil 36 is fixed to a diaphragm 35 provided with a coil fixing portion 39 having a recessed shape, and may be cemented with an adhesive or the like if necessary. The coil 36 is disposed in the magnetic gap G of the magnetic circuit.

The vibration transmitting portion 38 is provided with a stopper 40. The stopper 40 serves to prevent a collision between the magnetic circuit and the diaphragm 35 when the excessive power is applied to the vibration actuator.

The magnetic circuit may have an external magnet structure or a radial structure instead of the internal magnet structure of FIG. 3. The orientation of magnetic poles of the permanent magnet 32 may be either direction as long as it is an axial direction.

The suspension 34 is formed integral with the vibration transmitting portion 38 by insert molding, welding, bonding, or the like.

Normally, the diaphragm 35 is formed by a sheet-like film or cone paper and may have a planar shape, a dish-like shape, a curved surface shape, a corrugate shape, or a shape obtained by combining these shapes. In case of the curved surface shape, a single curvature or a combination of different curvatures may be adopted. The diaphragm is designed so as to achieve a predetermined acoustic property by such a combination and a thickness. In order to obtain a larger amplitude of the diaphragm 35, an outer peripheral portion of the diaphragm 35 may be fixed to the vibration transmitting portion 38 through an elastic material such as a pressure sensitive adhesive, an adhesive, or a resin if necessary. A through hole for air bleeding may be provided at a center portion of the center shaft 37.

The vibration transmitting portion 38 is made of a resin or the like that exhibits elastic action, and is formed into a case-like shape having a hollow portion for containing the magnetic circuit, the suspension 34, the diaphragm 35, and the coil 36. An upper cover 41 and a lower cover 42 closing upper and lower openings of the hollow portion are provided. The vibration transmitting portion 38, the upper cover 41, and the lower cover 42 form a cavity. For example, sound release holes 43 are optionally formed in the lower cover 42 so that the cavity satisfies the principle of the Helmholtz resonator. Attention must be paid so as not to allow the air to flow into or flow out from the cavity except through the sound release holes 43.

Note that the lower cover 42 also serves to prevent plastic deformation of the suspension 34 due to excessive vibration of the magnetic circuit.

The vibration transmitting portion 38 has a terminal table 44 integrally formed at a portion of its outer side surface and projecting outward. A terminal 45 is formed on the terminal table 44 and a lead wire 46 of the coil 36 is connected to the terminal 45. A signal for driving is applied to the coil 36 from this terminal 45.

In the vibration actuator of FIG. 3, let a signal of a single frequency around 100 Hz be input to the coil 36. In this event, since the coil 36 is located in the magnetic gap G of the magnetic circuit, the coil 36 and the magnetic circuit vibrate relative to each other in synchronization with the input frequency according to the Fleming's left hand rule. This vibration is output to the exterior from the vibration actuator through the vibration transmitting portion 38. This is a body sensible vibration and is a low-pitched tone as a sound.

When a signal of a single frequency around 2 kHz is input to the coil 36, the coil 36 and the magnetic circuit vibrate relative to each other in synchronization with the input frequency and the vibration of the coil 36 is transmitted to the diaphragm 35 to vibrate the diaphragm 35. This vibration falls within the human audible range because of its high frequency and thus can be heard as a sound. In this event, the vibration of the magnetic circuit is simultaneously transmitted through the vibration transmitting portion.

On the other hand, when a voice or music signal of several hundred to several thousand Hz is input into the coil 36, the diaphragm 35 vibrates. Since the diaphragm 35 is normally formed by a sheet-like film or cone paper, this vibration actuator can output a voice or music like an ordinary speaker.

Figure 12:
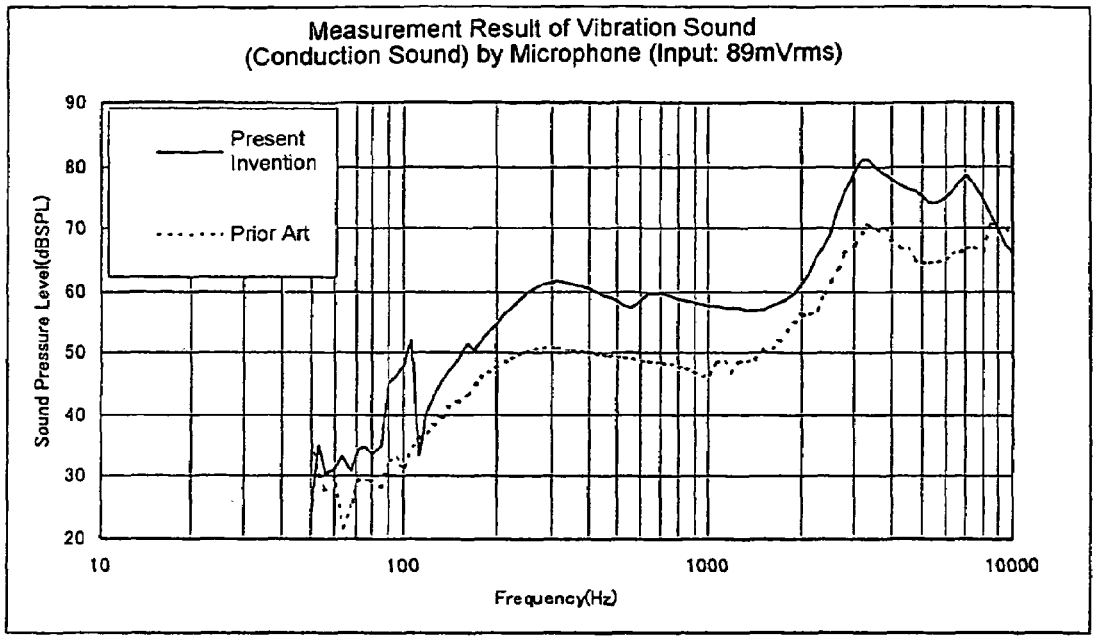
FIG. 12 is a graph showing vibration sound pressure characteristics of a prior art product and FIG. 3.
Figure 13:
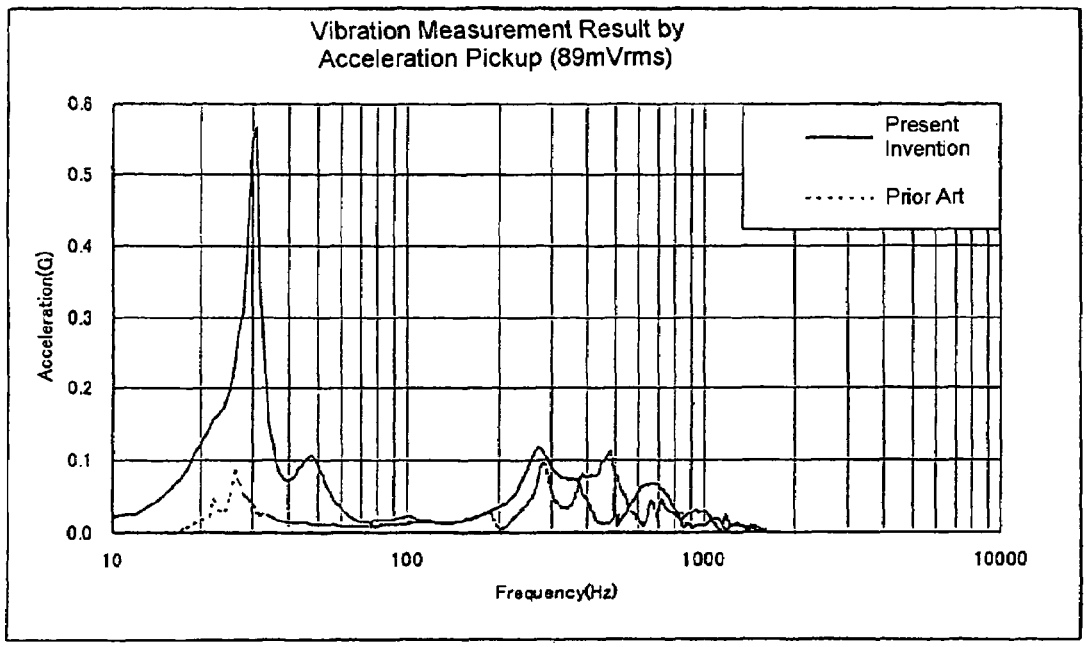
FIG. 13 is a graph showing conduction power characteristics of a prior art product and FIG. 3.

As described above, the vibration of the vibration actuator of the earphone or headphone of the present invention has a wideband frequency spectrum characteristic. For example, as shown in characteristic graphs of FIGS. 12 and 13, a vibration sound is about 55 dBSPL at 100 Hz, while a conduction power is about 0.55 G at 400 Hz. From this, the sound and the body sensible vibration can be output individually or simultaneously so that highly diversified expressions are made possible as compared with a simple motor sound of a conventional vibration motor.

In the above-mentioned vibration actuator, a resonance frequency of the magnetic circuit is determined from a weight of the magnetic circuit and a spring constant of the suspension 34. Therefore, the resonance frequency of the magnetic circuit can be synchronized with a bass sound of music by selecting the weight and the spring constant. This also makes it possible to place an accent on a musical composition output from the actuator. Thus, the actuator operates also as a woofer. It is therefore possible to produce outputs ranging from a bass sound to a high-pitched sound from one device for a small-sized audio system. It is possible to provide an earphone or headphone that operates like a two-way or a three-way speaker.

Figure 8:
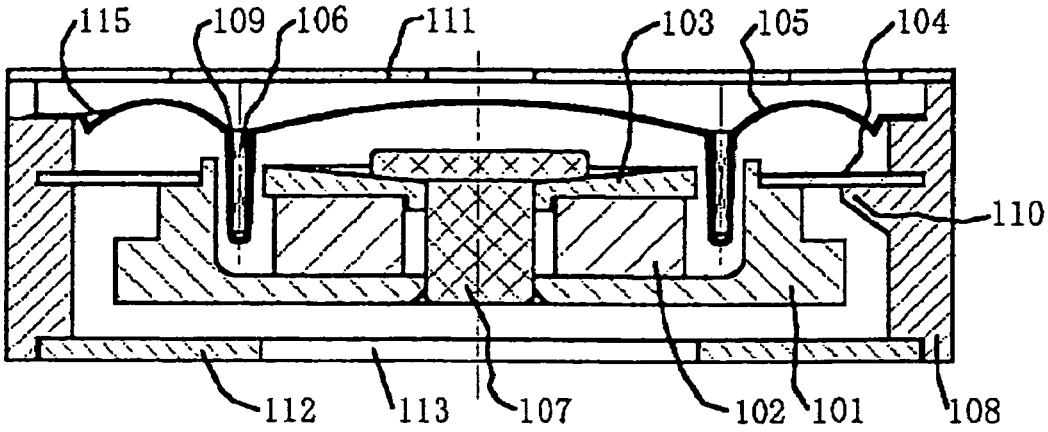
FIG. 8 is a sectional view showing another vibration actuator mounted in the earphone or headphone according to the present invention.
Figure 9:
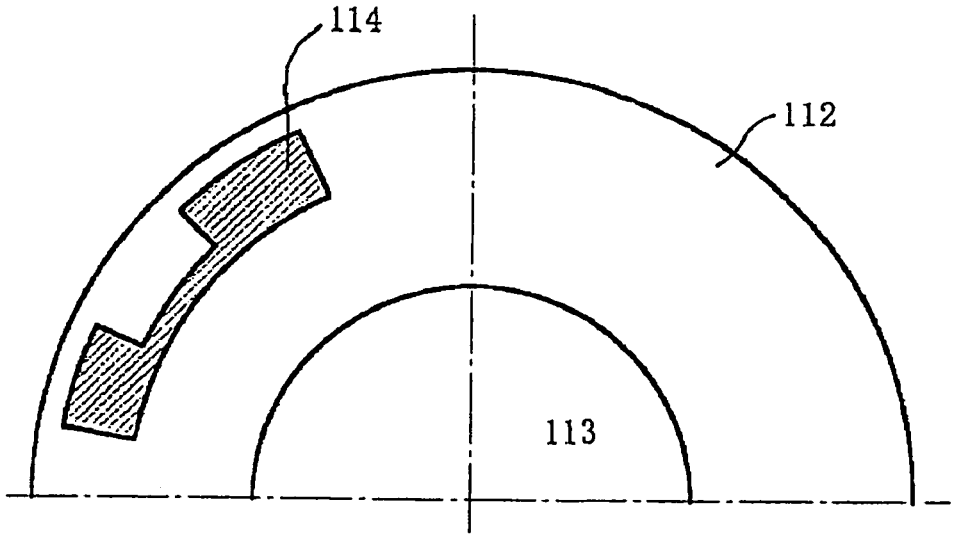
FIG. 9 is a plan view showing a half of an inner surface of only a lower cover in FIG. 8.

FIGS. 8 and 9 show another example of a vibration actuator used in an earphone or headphone of the present invention.

The structure of this vibration actuator comprises, like the vibration actuator of FIG. 3, a magnetic circuit of an internal magnet structure in which a permanent magnet 102, a yoke 101, and a plate 103 are fixed together by a center shaft 107 such as a bolt or a pin, a suspension 104 formed by a single piece of an arc-shaped helical leaf spring supporting the magnetic circuit, a vibration transmitting portion 108 in the shape of a hollow case fixing an outer end of the suspension and having a stopper 110, a diaphragm 105 having an outer end fixed to the vibration transmitting portion, a coil 106 attached to a coil fixing portion 109 of the diaphragm 105 and disposed in a magnetic gap of the magnetic circuit, and an upper cover 111 and a lower cover 112 closing upper and lower openings of a hollow portion of the vibration transmitting portion 108. The lower cover 112 also serves as a stopper for preventing plastic deformation of the suspension 104 caused by excessive vibration of the magnetic circuit.

The vibration actuator of FIG. 8 is different from that of FIG. 3 in that the shape of an outer peripheral portion of the yoke 101 differs from that of the yoke 31 in FIG. 3, that the terminal table 44 is not provided, and that sound release holes are also formed in the upper cover 111 and a sound release hole 113 of the lower cover is a large hole.

Referring to FIG. 9, a terminal 114 is disposed on an inner surface of the lower cover 112. Similarly to the lead wire 46 illustrated in FIG. 3, a lead wire 115 of the coil 106 is connected to the terminal 114. A signal for driving the coil is applied from the terminal 114. The terminal 114 may be a coil spring, a leaf spring, a connector, a gold-plated pad, or the like.

As a material of the lower cover 112, use may be made of any material, such as resin, rubber, cloth, paper, glass epoxy resin, other insulating materials, or insulating composite materials as long as it serves as an insulator.

As a material of the terminal 114, use may be made of any material, such as copper, gold, silver, other conductive materials, or conductor-plated or -printed materials as long as it serves as a conductor.

According to this embodiment, it is not necessary to project the terminal table outward from the vibration transmitting portion. Therefore, the vibration actuator can be reduced in outer dimension and, as compared with the vibration actuator in FIG. 3, can be easily incorporated into the earphone or headphone.

Figure 10:
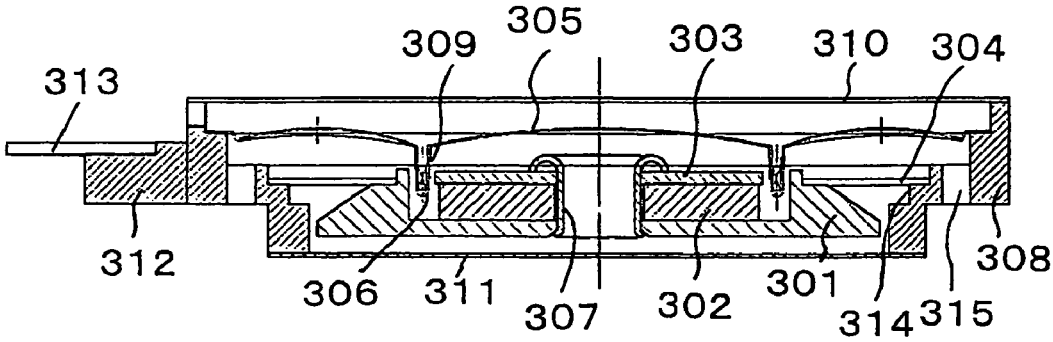
FIG. 10 is a sectional view showing still another vibration actuator mounted in the earphone or headphone according to the present invention.
Figure 11:
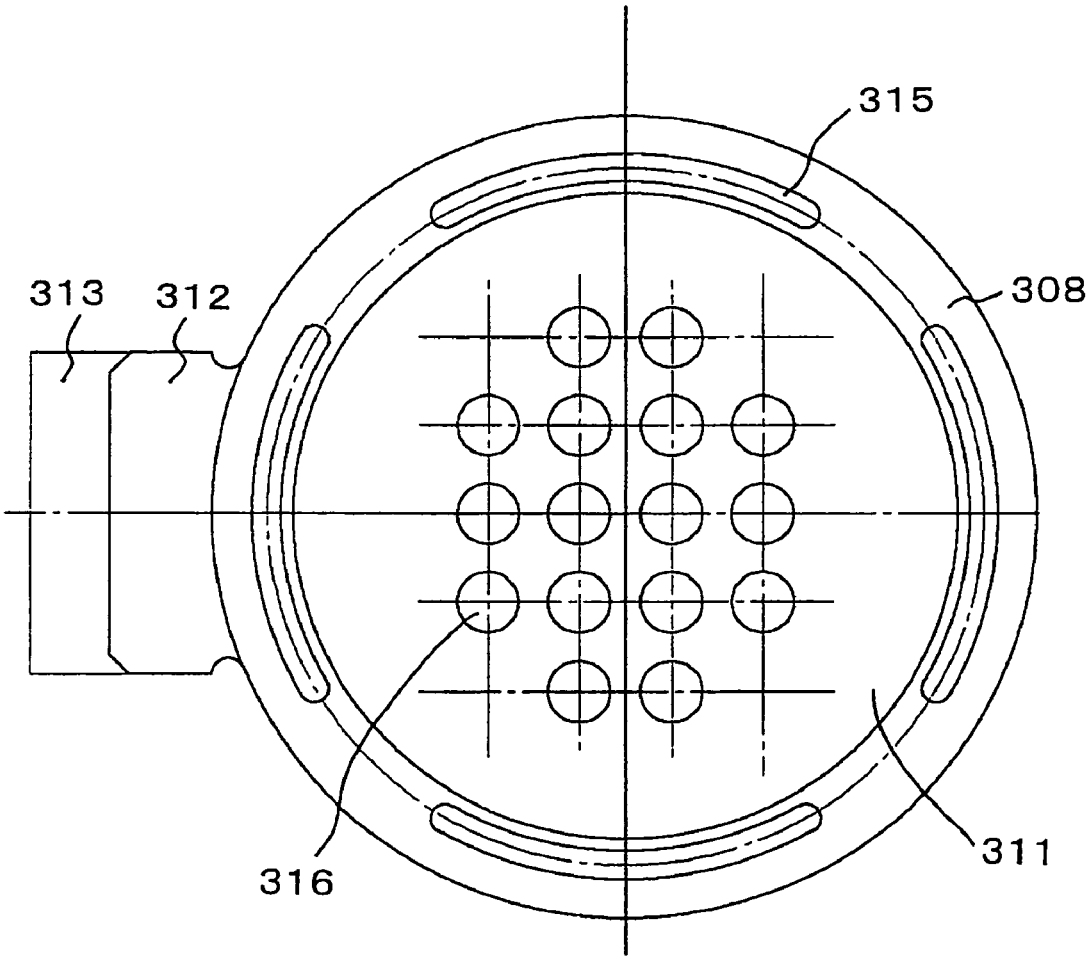
FIG. 11 is a bottom view of the vibration actuator of FIG. 10.

FIGS. 10 and 11 show another vibration actuator used in the present invention. The structure of this vibration actuator also comprises, like the vibration actuator of FIG. 3, a magnetic circuit of an internal magnet structure in which a permanent magnet 302, a yoke 301, and a plate 303 are fixed together by a center shaft 307 such as a rivet, a bolt, or a pin, a suspension 304 formed by a single piece of an arc-shaped helical leaf spring supporting the magnetic circuit, a vibration transmitting portion 308 in the shape of a hollow case fixing an outer end of the suspension, a diaphragm 305 having an outer end fixed to the vibration transmitting portion, a coil 306 attached to a coil fixing portion 309 of the diaphragm 305 and disposed in a magnetic gap of the magnetic circuit, an upper cover 310 and a lower cover 311 having sound release holes 316, which close upper and lower openings of a hollow portion of the vibration transmitting portion 308, a terminal table 312 projected outward from a portion of the vibration transmitting portion, and a terminal 313 attached to the terminal table.

The vibration actuator of FIG. 10 is different from the vibration actuator of FIG. 3 in that the vibration transmitting portion 308 of the former has a staircase-like stepped portion 314 formed at its inner wall portion and hat sound release holes 315 are formed at portions of this stepped portion. The stepped portion 314 is formed into a stair-climbing shape climbing up from the lower cover 311 toward the upper cover outward in the radial direction of the vibration transmitting portion. In the illustrated example, the suspension 304 is attached to the second stair and prevents rolling of the magnetic circuit. The sound release holes 315 are formed at the third stair so as to penetrate therethrough downward. The diaphragm 305 is fixed to the fourth stair.

Based on these differences from the vibration actuator of FIG. 3, the vibration actuator of FIGS. 10 and 11 can ensure a sound pressure characteristic thereof even when a printed board, a panel, or any other wall member exists in contact with the back of the vibration actuator and a sufficient back cavity cannot be ensured.

Figure 14:
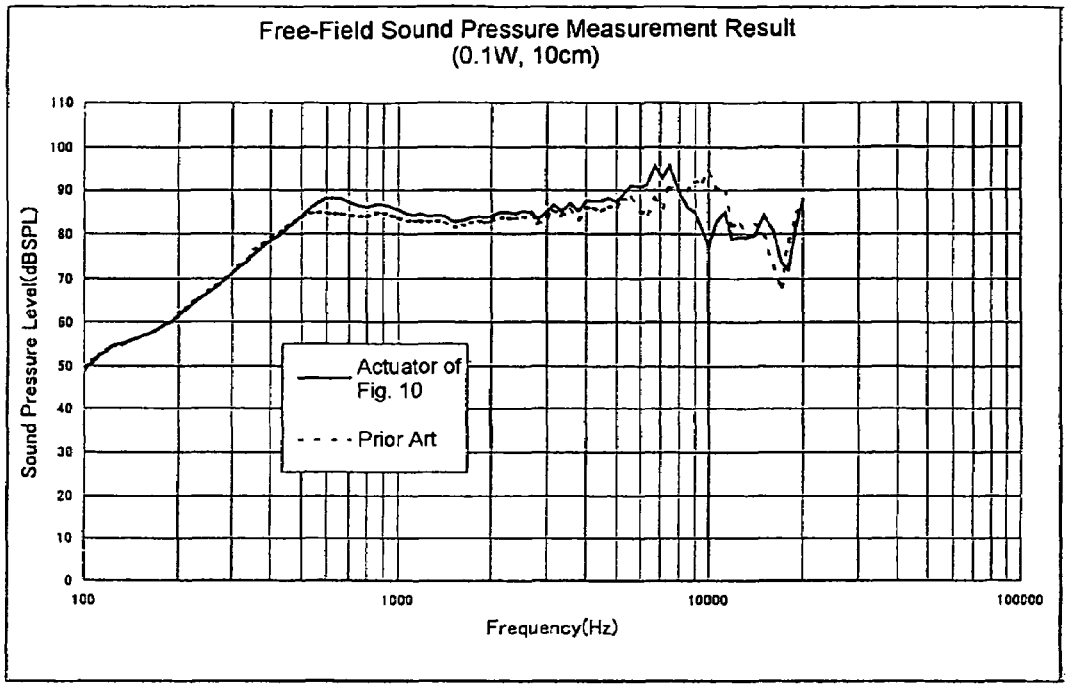
FIG. 14 is a graph showing sound pressure characteristics in case of presence of air holes in a vibrating transmitting portion having a stepped structure in the present invention (FIG. 10) and in case of absence of air holes (prior art).

FIG. 14 shows a sound pressure characteristic of the vibration actuator shown in FIGS. 10 and 11 (with the panel attached on its back). It is seen that the characteristic can be improved by 2 to 3 dB between 500 Hz and 8 kHz as compared with the prior art.

Therefore, the vibration actuator of FIG. 10 is suitable for use in an earphone or headphone having a structure where a casing wall is contacted with the back of the vibration actuator.

In the foregoing embodiments of FIGS. 3, 8, and 10, the bolt, the rivet, the pin, or the like is used as the center shaft of the magnetic circuit. Instead, the yoke, the plate, and the permanent magnet may be fixed by the method of bonding or the like.

Normally, as a device for making an acoustic transducing element be in close vicinity to an ear, use is typically made of a headphone of the type in which an acoustic transducing element is pressed against the ear by wearing a cranial headband or a neckband. Besides, there are an inner ear type in which the element is inserted into an auricle of ear and retained therein (often called an earphone in distinction from a headphone), and an ear fit type in which a support arm is hooked over the ear to dispose the element on the side of the ear.

In the present invention, the term of an "earphone or headphone" is used for collectively referring to the foregoing three types.

The invention claimed is:

1. An earphone or headphone having a vibration actuator mounted as an electroacoustic transducer, said vibration actuator comprising:

a magnetic circuit including a permanent magnet, a yoke, and a plate used for concentrating magnetic flux of said permanent magnet, wherein said magnetic circuit has a magnetic gap at a portion thereof;

a coil disposed in the magnetic gap of said magnetic circuit;

a vibrating plate attached with said coil and imparted with a driving force by said coil;

a suspension which is formed by a flexible spring and which supports said magnetic circuit;

a vibration transmitting portion which fixes said suspension; and a cover which covers an outer side, and a terminal for electrical connection disposed on said cover.

2. An earphone or headphone according to claim 1, wherein, by simultaneously inputting a low frequency signal for generating a body sensible vibration and a signal for generating a sound and having a frequency higher than that of said low frequency signal, said vibration actuator simultaneously generates said body sensible vibration and said sound.

3. An earphone or headphone according to claim 2, wherein, in said vibration actuator, said magnetic circuit vibrates in response to an input signal of a low-band frequency that generates said body sensible vibration and a low-pitched tone, both of said vibrating plate and said magnetic circuit vibrate in response to an input signal of an intermediate-band frequency, and said vibrating plate vibrates in response to an input signal of a high-band frequency to produce a high-pitched tone.

4. An earphone or headphone according to claim 1, wherein, in said vibration actuator, said magnetic circuit vibrates in response to an input signal of a low-band frequency that generates a body sensible vibration and a low-pitched tone, both of said vibrating plate and said magnetic circuit vibrate in response to an input signal of an intermediate-band frequency, and said vibrating plate vibrates in response to an input signal of a high-band frequency to produce a high-pitched tone.

5. An earphone or headphone according to claim 1, wherein the terminal for electrical connection is provided inside a vibrator.

6. An earphone or headphone according to claim 1, wherein said cover has a sound release hole for air viscosity attenuation.

7. An earphone or headphone according to claim 1, wherein the vibration actuator has a stepped structure disposed at an outer periphery of said magnetic circuit to protect rolling of said magnetic circuit.

8. An earphone or headphone according to claim 7, wherein said stepped structure has an air hole.

9. An earphone or headphone according to claim 1, wherein, in said vibration actuator, said magnetic circuit has a vibration resonance frequency between 60 Hz and 300 Hz.

10. An earphone or headphone according to claim 9, wherein the earphone or headphone allows bodily sensation of "a vibration sound" felt by tactile sense.

11. An earphone or headphone according to claim 9, wherein the earphone or headphone allows bodily sensation of "a tactile sound" felt by tactile sense.

12. An earphone or headphone according to claim 9, wherein the earphone or headphone allows bodily sensation of "a conduction sound" felt by tactile sense.

* * * * *